US007766127B2

(12) United States Patent
Morris et al.

(10) Patent No.: US 7,766,127 B2
(45) Date of Patent: Aug. 3, 2010

(54) BARRIER ASSEMBLY FOR A WHEELCHAIR LIFT

(75) Inventors: Don Morris, Conifer, CO (US); Roger Young, Waterford, CA (US)

(73) Assignee: Lift-U, Division of Hogan Mfg., Inc., Escalon, CA (US)

( * ) Notice: Subject to any disclaimer, the term of this patent is extended or adjusted under 35 U.S.C. 154(b) by 38 days.

(21) Appl. No.: 11/470,529

(22) Filed: Sep. 6, 2006

(65) Prior Publication Data

US 2008/0121467 A1 May 29, 2008

(51) Int. Cl.
*B66B 9/08* (2006.01)
*E04F 10/00* (2006.01)

(52) U.S. Cl. ..... 187/200; 160/37

(58) Field of Classification Search ..... 187/200–202; 160/36, 37

See application file for complete search history.

(56) References Cited

U.S. PATENT DOCUMENTS

| | | | | | |
|---|---|---|---|---|---|
| 45,366 | A | * | 12/1864 | Vrydagh | 160/36 |
| 1,009,046 | A | * | 11/1911 | Busch | 160/188 |
| 1,209,129 | A | * | 12/1916 | Coss | 160/33 |
| 1,275,477 | A | * | 8/1918 | Ruble et al. | 160/188 |
| 1,782,110 | A | * | 11/1930 | Wetzler | 217/62 |
| 1,828,065 | A | * | 10/1931 | Palm | 187/333 |
| 2,231,005 | A | * | 2/1941 | Gordon | 312/260 |
| 3,989,084 | A | * | 11/1976 | Inamura et al. | 160/36 |
| 4,595,043 | A | * | 6/1986 | Nozawa et al. | 160/36 |
| 4,953,665 | A | | 9/1990 | Paquin | |
| 4,966,219 | A | * | 10/1990 | Sonolet | 160/201 |
| 4,977,981 | A | | 12/1990 | Paquin | |
| 5,236,260 | A | * | 8/1993 | Yu | 312/297 |
| 6,182,798 | B1 | * | 2/2001 | Brady et al. | 187/282 |
| 6,305,456 | B1 | * | 10/2001 | Sanchez | 160/188 |
| 2003/0213653 | A1 | * | 11/2003 | Morris | 187/269 |

OTHER PUBLICATIONS

International Search Report dated Jul. 11, 2008, issued in corresponding Application No. PCT/US06/35115, filed Sep. 6, 2006.

* cited by examiner

*Primary Examiner*—Evan H Langdon
(74) *Attorney, Agent, or Firm*—Christensen O'Connor Johnson Kindness PLLC

(57) ABSTRACT

A barrier assembly for a wheelchair lift assembly is provided. The wheelchair lift assembly includes a lift frame and a platform reciprocally coupled to the lift frame. The barrier assembly includes a frame having a first side rail and a second side rail. The frame is coupled to at least one of the lift frame or a structural frame. The barrier assembly also includes a barrier slidably disposed between the first and second side rails. A drive assembly is operably coupled to the barrier for selectively moving the barrier between at least a stowed position and a deployed position.

14 Claims, 6 Drawing Sheets

BARRIER ASSEMBLY FOR A WHEELCHAIR LIFT

BACKGROUND

Persons with mobility impairments often depend on a wheelchair or walking aid to facilitate mobility. As a result, they are frequently subjected to physical barriers and obstacles such as stairs and curbs. Current ADA legislation requires that these physical barriers be removed, and as a result, ramps have been designed to address this need. However, ramps can be very long and difficult to climb. Further, depending on the elevation change and available space, ramps may be impractical. One solution is a wheelchair lift. Wheelchair lifts for commercial buildings and private residences must be designed and tested to meet the requirements of the ASME Code: A18.1, SAFETY STANDARD FOR PLATFORM LIFTS AND STAIRWAY CHAIRLIFTS.

Platform lifts for wheelchairs have been developed for use in courtrooms, church pulpits, meeting chamber podiums, and other similar environments. These types of installations must not only provide a means for safe level changes, but must also be sensitive to decorum and surrounding architecture. Moreover, certain multi-level environments, such as courtrooms, require a lift that services multiple levels, such as the witness stand and the judge's bench. In a courtroom, the witness stand, or intermediate level, is not normally large enough to accommodate a hinged door. Thus the potential for an unsafe condition occurs when the lift platform is raised above the witness level, and conversely when the lift platform is lowered from witness level to courtroom floor level. This condition may also be present for a variety of other wheelchair lift assemblies when the lift is being moved.

SUMMARY

A barrier assembly for a wheelchair lift assembly is provided. The wheelchair lift assembly includes a lift frame and a platform reciprocally coupled to the lift frame. The barrier assembly includes a frame having a first side rail and a second side rail. The frame is coupled to at least one of the lift frame or a structural frame. The barrier assembly also includes a barrier slidably disposed between the first and second side rails. A drive assembly is operably coupled to the barrier for selectively moving the barrier between at least a stowed position and a deployed position.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of the claimed subject matter will become better understood by reference to the following detailed description, when taken in conjunction with the accompanying drawings, wherein:

DETAILED DESCRIPTION

Figure 1:
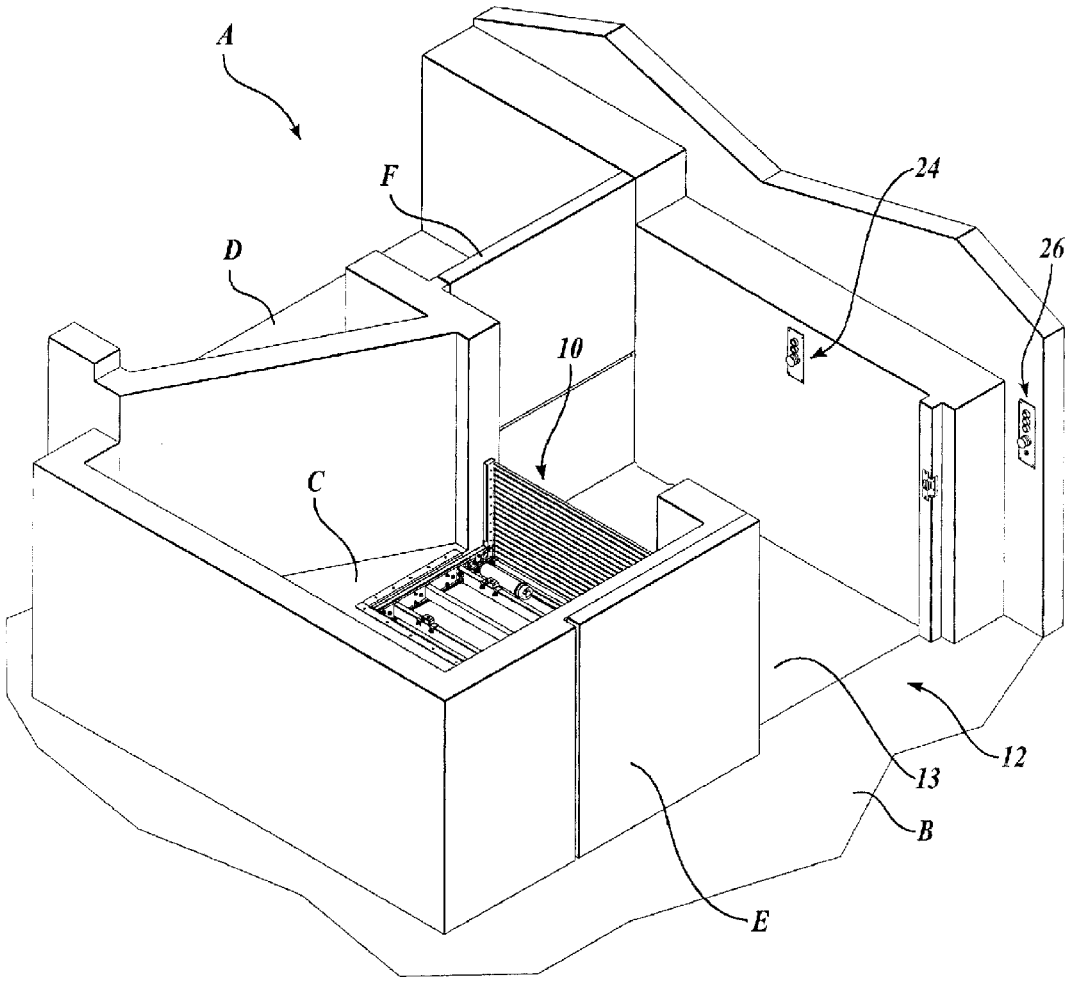
FIG. 1 is an environmental view of a representative embodiment of a barrier assembly suitable for use with a wheelchair lift assembly constructed in accordance with one embodiment of the present disclosure, wherein the barrier assembly is in the deployed position.

A barrier assembly 10 constructed in accordance with one embodiment of the present disclosure is best seen by referring to FIG. 1. The barrier assembly 10 is shown in combination with a wheelchair lift assembly 12; however, it should be appreciated that the scope of the barrier assembly 10 is not so limited, with other uses being within the scope of the present disclosure. From time to time throughout this specification, directional terms, such as vertical, horizontal, top, bottom, etc., are used in the description of various components. It should be apparent that the use of such terms is merely for convenience and, as such, is not intended to limit the embodiments or claims contained herein.

As best shown in FIG. 1, the wheelchair lift assembly 12 includes a lift platform 13 that is reciprocally coupled to a lift frame (not shown). The lift frame is incorporated within a courtroom assembly A having a ground level B, such as a courtroom floor, an intermediate level C, such as a witness stand, and an upper level D, such as a judge's bench. The platform 13 is vertically translatable between at least the ground level B, the intermediate level C, and the upper level D by a driving assembly (not shown) well known in the art. It should be appreciated that while the barrier assembly 10 and wheelchair lift assembly 12 are shown being used in a courtroom assembly A, the barrier assembly 10 and wheelchair lift assembly 12 may instead be used in a variety of other environmental settings.

The courtroom assembly A further includes a lower landing door E hingedly coupled to the courtroom assembly A at the ground level B adjacent the wheelchair lift assembly 12 and an upper landing door F hingedly coupled to the courtroom assembly A at the upper level D adjacent the wheelchair lift assembly 12. The hinges of the upper and lower landing doors E and F are spring-loaded such that the doors are urged into the closed positions when not being held open.

The wheelchair lift assembly 12 includes a suitable control system (not shown) having a programmable logic controller (PLC) that controls the operation of the lift platform 13 and the barrier assembly 10. An internal control panel 24 and an external control panel 26 may be used to send command signals to the control system of the wheelchair assembly 12 when, for instance, a passenger wishes to move the lift platform 13 from one level to another. Moreover, the landing doors E and F include electric strike latches (not shown), and the control system does not actuate the lift platform 13 until the control system receives a signal that doors E and F are in the closed position. The control system also controls the operation of the barrier assembly 10, which will be hereinafter described below.

Still referring to FIG. 1, one representative embodiment of the barrier assembly 10 will now be described in detail. The barrier assembly 10 is operably coupled to the wheelchair lift assembly 12 at the intermediate level C. In use, the barrier assembly 10 is translated into a deployed position to protect a passenger when the lift platform 13 is being raised or lowered or when the lift platform 13 is not positioned at the intermediate level C.

Figure 2:
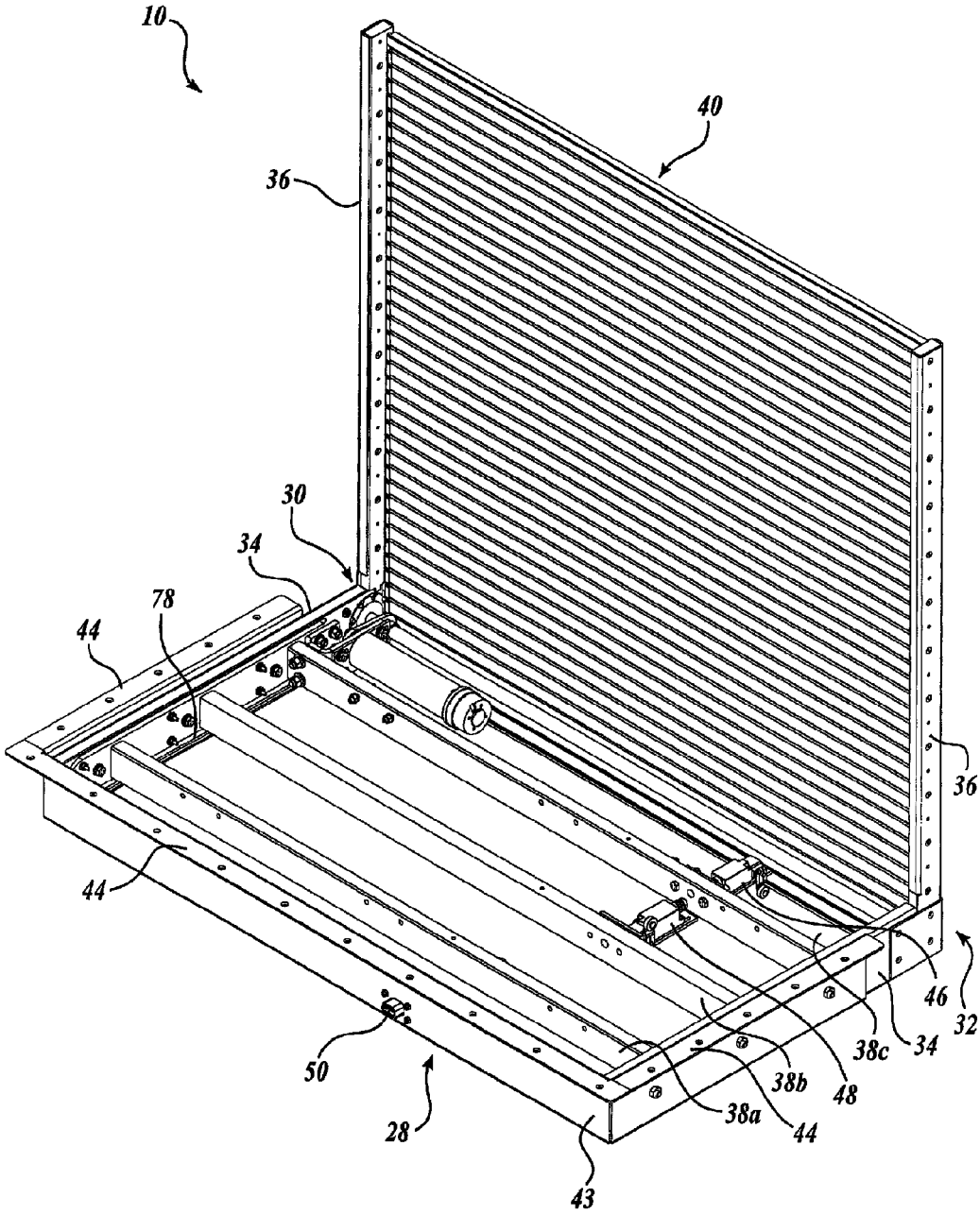
FIG. 2 is an isometric view of the barrier assembly of FIG. 1.

Referring now to FIG. 2, the barrier assembly 10 includes a frame 28 having first and second side rails 30 and 32 disposed opposite one another. The first and second side rails 30 and 32 are substantially identical; therefore, only the first side rail 30 will be described. As can best be seen by referring to FIG. 3, the first side rail 30 includes an L-shaped outer shell 33 having a horizontal portion 34 and a vertical portion 36. A horizontal guide rail 35 is sized and shaped to be received within the horizontal portion 34 of the outer shell 33, and a vertical guide rail 37 is sized and shaped to be received within the vertical portion 36 of the outer shell 33. The horizontal and vertical guide rails 35 and 37 may be secured within the outer shell 33 with any suitable mechanical or chemical fasteners, such as screws, bolts, rivets, glue, epoxy, etc.

A plurality of cross-members 38*a*-38*c* extend between the first and second side rails 30 and 32 to couple the side rails together and define the frame 28. Preferably, the frame 28 includes first, second, and third cross-members 38*a*, 38*b*, and 38*c*, respectively; however, fewer or more than three cross-members may be used. In the embodiment shown, the first cross-member 38*a* spans between the proximal ends of the horizontal portions of the first and second slide rails 30 and 32, the third cross-member 38*c* spans between corners of the first and second slide rails 30 and 32, and the second cross-member 38*b* is positioned between the first and second cross-members 38*a* and 38*c*. A stop bracket 70 may also be provided, which extends between the first and second side rails 30 and 32. The stop bracket 70 includes flanged ends 71 that are coupled to the horizontal portions 34 of the outer shells 33.

At least a portion of the frame 28 is received within a mounting tray 43 for securing the barrier assembly 10 beneath the intermediate level C. When installed, the horizontal portions of the first and second side rails 30 and 32 are received within the mounting tray 43, and the mounting tray 43 is received within an opening in the flooring defining the intermediate level C. Flanges 44 extending around the exterior of the mounting tray 43 rest on the flooring, and the mounting tray 43 is covered with a panel (not shown) made of steel, aluminum, wood, or another suitable material, wherein the panel is co-planar with the intermediate level C. The vertical portions of the first and second side rails 30 and 32 extend upwardly from beneath the intermediate level C and are preferably secured to at least a portion of a structural frame in the courtroom assembly A.

The vertical guide rails 37 of the frame 28 include a vertical guiding groove 76 formed along the length of the vertical guide rails 37. The horizontal guide rails 35 include a lower horizontal guiding groove 78 formed along the bottom of the horizontal guide rail 35 and an upper horizontal guiding groove 79 formed along the top of the horizontal guide rail 35. The lower horizontal guiding groove 78 is placed in communication with the vertical guiding groove 76 at its distal end by a first curved portion 81. The lower horizontal guiding groove 78 and the upper horizontal guiding groove 79 are placed in communication at their proximal ends with a second curved portion 83. The vertical guiding groove 76, lower horizontal guiding groove 78, and upper horizontal guiding groove 79 form one continuous guiding groove 74. The horizontal and vertical guide rails 35 and 37 are preferably formed with a low-friction material, such as UHMW polyethylene or Nylatron®, such that a barrier in the form of a barrier segment assembly 40 may be slidably received within the guiding grooves 74 of the first and second side rails 30 and 32.

Referring to FIG. 2, the barrier segment assembly 40 is comprised of a plurality of extruded barrier segments 42 hingedly coupled to one another according to any suitable method well known in the art. The upper-most barrier segment 72 includes a shoulder (not shown) that rests against the stop bracket 70 when the barrier segment assembly 40 is in the stowed position.

A pin 68 protrudes from the ends of each barrier segment 42. When assembled, the pins 68 are slidably received within the guiding grooves 74 formed within the first and second side rails 30 and 32. The pins 68 are formed with a suitable low-fiction material, such as, but not limited to Delrin®, which allows the pins 68 to slide freely within the guiding grooves 74. It should be appreciated that any suitable barrier element(s) may be used without departing from the spirit and scope of the present disclosure, As a non-limiting example, a solid piece of flexible material may instead be slidably disposed between the first and second side rails 30 and 32.

A drive assembly 94 is operably coupled to the barrier segment assembly 40 for slidably translating the barrier segment assembly 40 within the guiding grooves 74. The drive assembly 94 includes a drive axle 88 that spans between the first and second side rails 30 and 32. Each end of the drive axle 88 coaxially receives a sprocket 80 and is thereafter journaled for rotation within openings in each side rail 30 and 32 in the corner defined by the intersection of the horizontal and vertical portions 35 and 37. A sprocket cavity 82 is formed within each horizontal guide rail 35 such that the sprocket cavity 82 is in communication with the first curved portion 81 of the guiding groove 74. The sprocket 80 is rotatably received within the sprocket cavity 82 such that the sprocket teeth engage the pins 68 when the barrier segment assembly is slidably received within the guiding groove 74.

The drive assembly 94 further includes a motor 96 operably coupled to the drive axle 88 for selective rotation thereof. The motor 96 is coupled to the cross-member 38*c* through a motor mounting bracket 90 or similar device. The motor 96 rotatably drives the drive axle 88 about its center longitudinal axis through any conventional transmission, such as a roller chain assembly 98. In the alternative, a drive belt assembly, gear assembly, etc. may instead be used to drive the drive axle 88.

The rotation of the drive axle 88 rotates the sprockets 80 disposed on each end thereof. The rotation of the sprockets 80 drives the barrier segment assembly 40 within the guiding grooves 74 either upwards within the vertical guiding groove 76 or downwards into the upper and lower horizontal guiding grooves 79 and 78 between a barrier deployed position and a barrier stowed position.

The control system of the wheelchair lift assembly 12 controls the operation of the barrier assembly 10. The barrier assembly 10 includes control components for communicating with the control system of the wheelchair lift assembly 12. A plurality of electrical or mechanical sensors are coupled to the frame 28 for indicating the barrier segment assembly 40 position. The sensors also signal the control system of wheelchair lift assembly 12 to instruct the motor 96 to turn on, off, or reverse directions when actuated by the barrier segment assembly 40. Preferably, a first mechanical limit switch 46 is mounted to the third cross member 38*c*, and a second mechanical limit switch 48 is mounted to the second cross-member 38*b*. Although any general purpose limit switches or proximity sensors may be used, adjustable roller lever limit switches are preferred.

The first limit switch 46 includes a lever arm pivotally mounted to a switching mechanism (not shown) within the limit switch 46. The lever arm of the first limit switch 46 is directed downwardly from the third cross-member 38*c* such that the barrier segment assembly 40 engages the lever arm when it is slidably received within the horizontal guiding groove 78. When at least a portion of the barrier segment assembly 40 is slidably moved from the horizontal guiding groove 78 to the vertical guiding groove 76 (i.e. from the stowed position to the deployed position), the barrier segment assembly 40 disengages the lever arm of the first limit switch 46, thereby actuating the switch and sending a signal to the control system to turn the motor 96 off. As a non-limiting example, and illustrated in FIG. 3, as the barrier segment assembly 40 nears its fully deployed position, a portion of the barrier segment assembly 40 disengages the limit switch 46, as described above.

The lever arm of the second limit switch 48 is directed upwardly from the second cross-member 38*b* such that when the barrier segment assembly 40 is substantially received within the horizontal guiding grooves 78 and 79 (i.e. in the stowed position), the barrier segment assembly 40 engages the lever arm of the second limit switch 48, thereby actuating the switch and sending a signal to the control system to turn the motor 96 off.

The motor 96 may include a spring-loaded break (not shown) for maintaining the barrier segment assembly 40 in the deployed position. The break may be applied when power to the motor 96 is removed, and the break may be released when the motor 96 is activated by the wheelchair lift assembly 12 control system to move the barrier segment assembly 40 into the stowed position.

A plurality of optional sensors (not shown) may also be electrically connected to the barrier assembly 10 for detecting approaching pedestrians or other moving objects, which can prevent the barrier segment assembly 40 from being deployed. Further, the barrier assembly 10 or wheelchair lift assembly 12 may include other electrical sensors (not shown), such as tape-switches or optical sensors, or over-current circuitry (not shown) that prevent the barrier segment assembly 40 from being further deployed when the uppermost barrier segment 72 of the barrier segment assembly 40 is obstructed. The motor 96, limit switches 46 and 48, and any optional sensors (i.e. tape switches or optical sensors) or over-current circuitry positioned within the barrier assembly 10 are electrically connected in any well known manner to the wheelchair lift assembly 12 through an electrical terminal 50.

In operation, the barrier segment assembly 40 is moved between a deployed position and a stowed position. In the courtroom assembly A, the barrier segment assembly 40 is moved into the deployed position by the control system before the lift platform 13 can be vertically translated. The barrier segment assembly 40 is moved into the stowed position when the lift platform 13 is at the intermediate level C, and a person desires to move between the intermediate level C and the lift platform 13.

Figure 3:
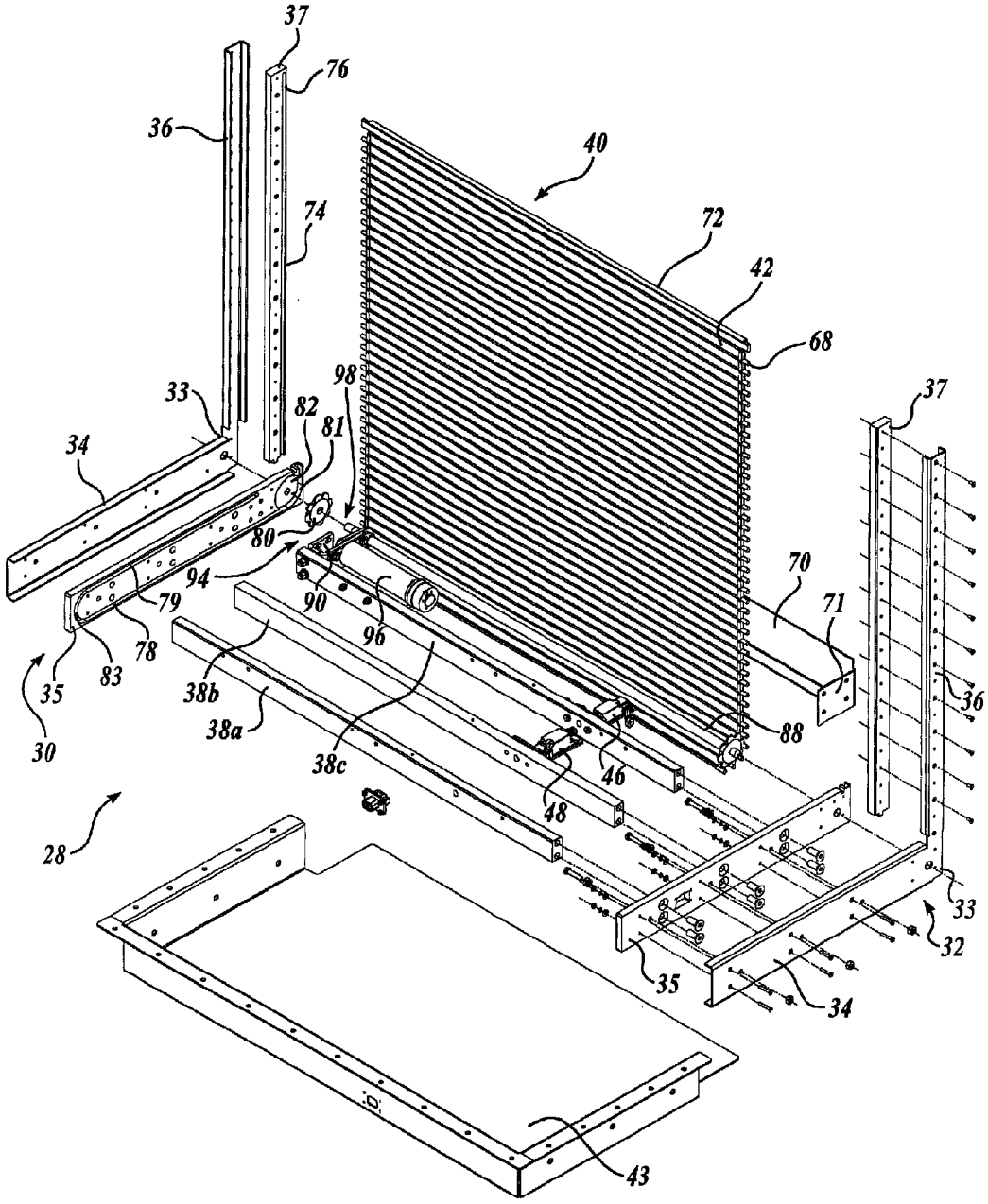
FIG. 3 is an exploded view of the barrier assembly of FIG. 2.

Referring to FIGS. 1-3, to move the barrier assembly 10 into the deployed position, the wheelchair lift assembly 12 is activated by depressing an appropriate button or switch on the internal control panel 24 or the external control panel 26. The control system of the wheelchair lift assembly 12 receives the signal that the lift platform 13 is about to be moved, and the motor 96 of the barrier assembly 10 is energized. The motor 96 rotates the drive axle 88 and sprockets 80, causing the barrier segment assembly 40 to slidably move upwardly into the vertical guiding grooves 76 until the barrier segment assembly 40 disengages the first limit switch 46 and the motor 96 turns off. In the deployed position, substantially all of the barrier segment assembly 40 is received within the vertical guiding grooves 76 to define a protective barrier. The barrier assembly 10 remains in the deployed position until the passenger wishes to exit at the intermediate level C.

Figure 4:
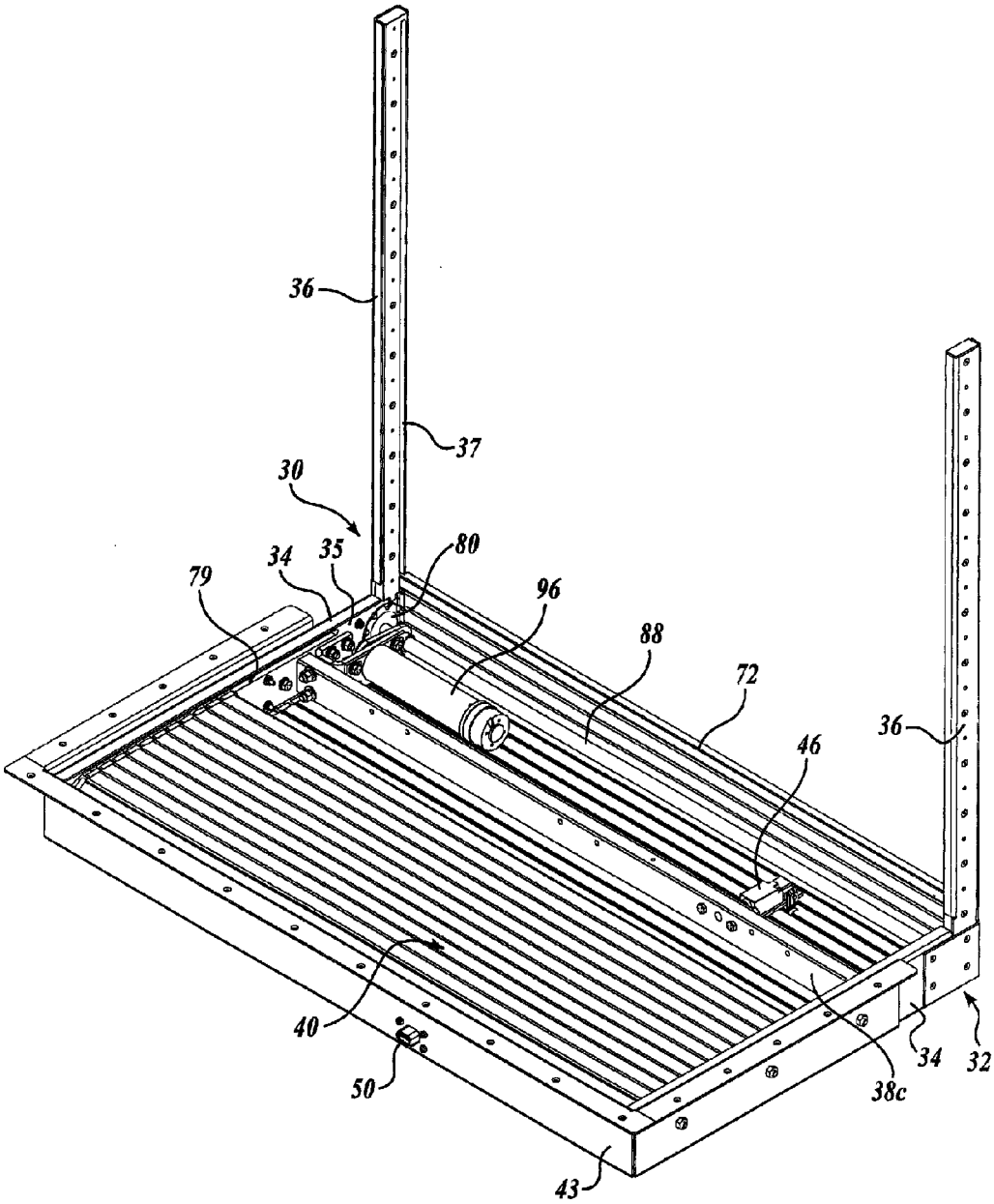
FIG. 4 is an isometric view of the barrier assembly of FIG. 2 in a stowed position.

Referring to FIG. 4, the barrier assembly 10 is moved into the stowed position when, for example, the lift platform 13 reaches the intermediate level C and the passenger wishes to move from the lift platform 13 to the intermediate level C. At this point, the motor 96 is energized, causing the drive axle 88 and sprockets 80 to rotate, thereby slidably moving the barrier segment assembly 40 downwardly into the horizontal guiding grooves 78 and 79. In the depicted embodiment, the barrier segment assembly 40 is substantially received within the lower and upper horizontal guiding grooves 78 and 79 such that a portion of the barrier segment assembly 40 is doubled back upon itself within the upper horizontal guiding grooves 79. However, it should be appreciated that a smaller barrier segment assembly 40 would only be received within the lower horizontal guiding grooves 78 in the stowed position.

When the barrier segment assembly 40 is substantially received within the horizontal guiding grooves 78 and 79, the shoulder of the upper-most barrier segment 72 abuts the stop bracket 70. Moreover, in the depicted embodiment, the barrier segment assembly 40 engages the second limit switch 48 and actuates the switch 48 to turn off the motor 96. At this time, the barrier segment assembly 40 is in the stowed position and the passenger may move from the lift platform 13 to the intermediate level C.

Figure 5:
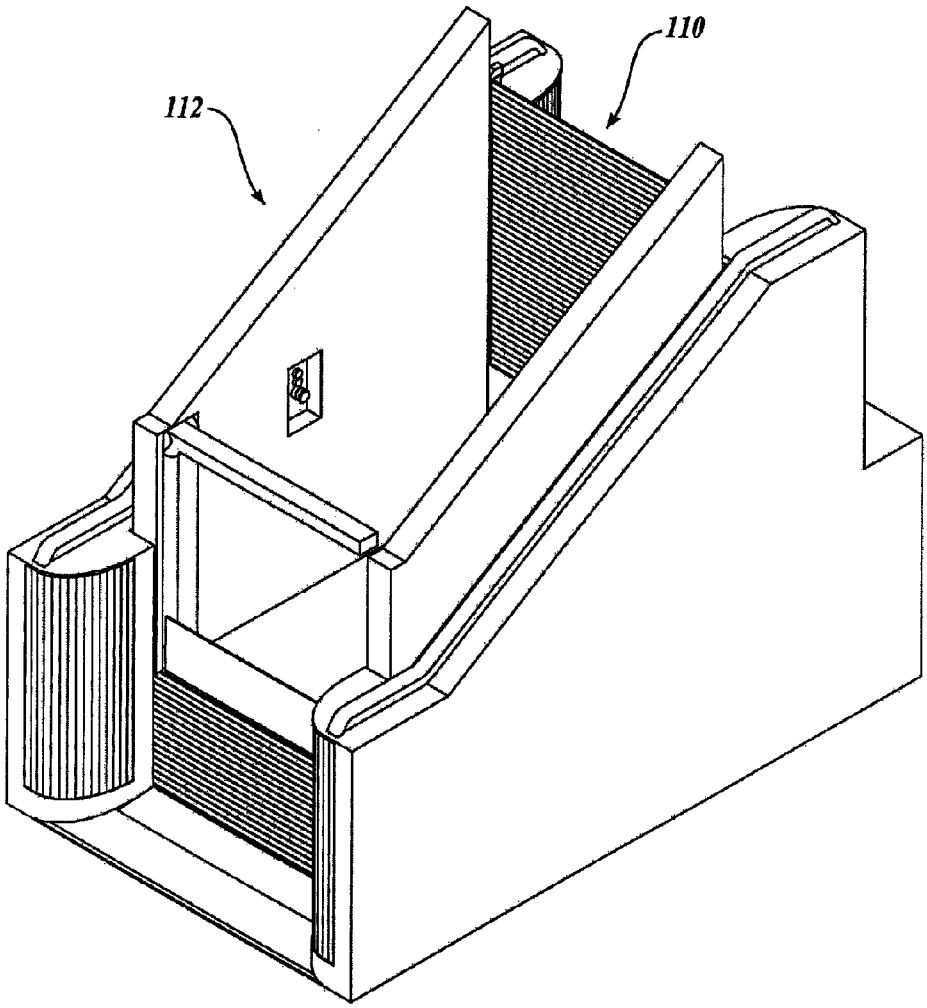
FIG. 5 is an environmental view of an alternate representative embodiment of a barrier assembly suitable for use with a wheelchair lift assembly.

Referring to FIG. 5, an alternate embodiment of a barrier assembly 110 is depicted in combination with a wheelchair lift assembly 112. The wheelchair lift assembly 112 includes a convertible stair/lift mechanism for moving a person from a lower surface to a vertically displaced upper surface and having a number of retractable stairs (such as the wheelchair lift depicted in U.S. Pat. No. 6,601,677B1). The barrier assembly 110 is translated into a deployed position to protect a passenger when the lift platform of the wheelchair lift assembly 112 is being raised or lowered, or when the stairs are retracted or when the lift platform is not positioned at the upper level. However, it should be appreciated that the barrier assembly 110 may be used with any suitable wheelchair lift assembly.

Figure 6:
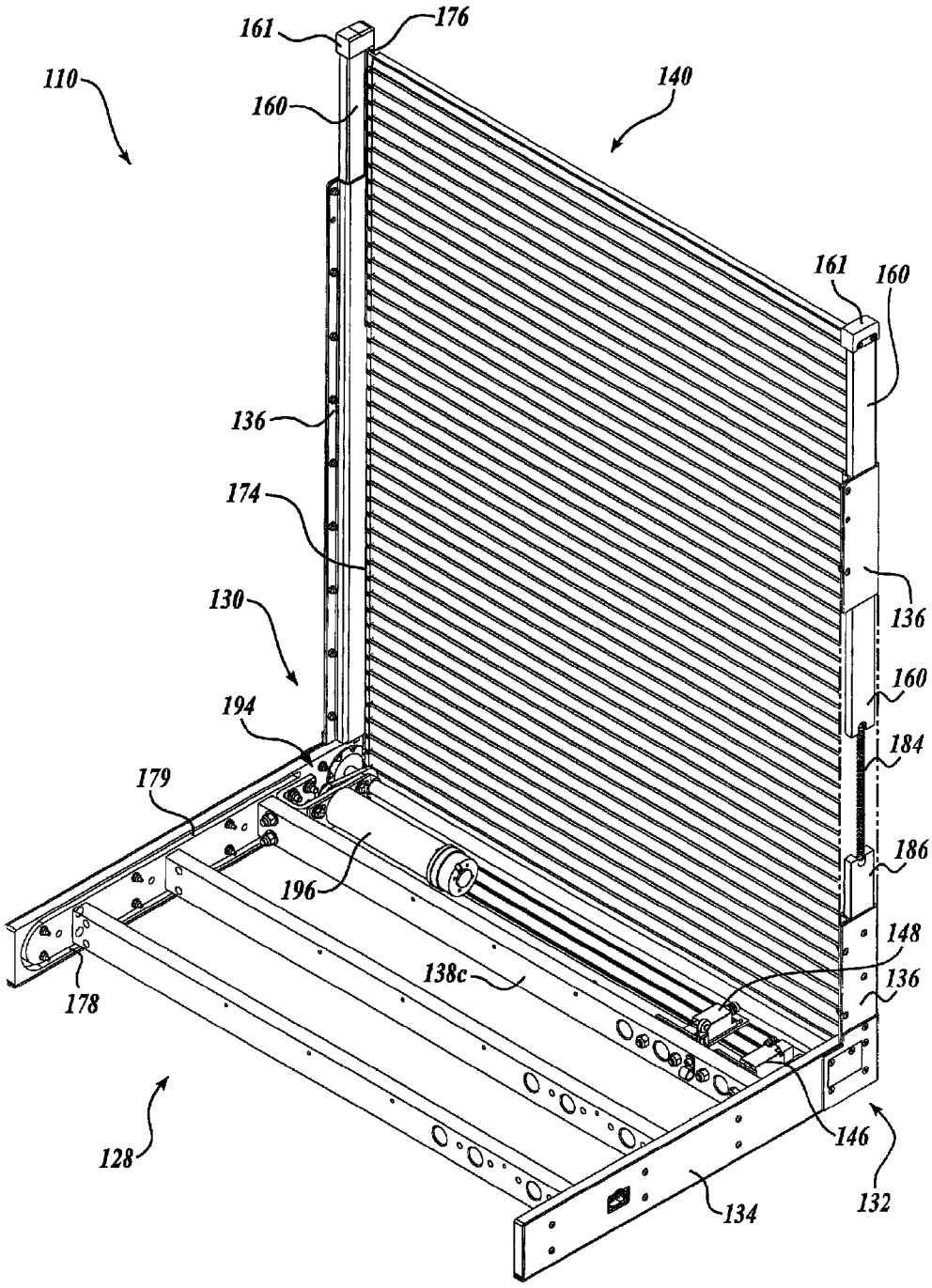
FIG. 6 is an isometric view of the barrier assembly of FIG. 5 partially broken away.

As can best be seen by referring to FIG. 6, the barrier assemblies 10 and 110 are substantially identical in materials, construction, and operation except for the differences that will be hereinafter described. The first and second side rails 130 and 132 of the barrier assembly 110 include a longitudinal hollow element 136 that is suitably shaped to slidably receive a first longitudinal segment 160 within the upper portion of the longitudinal hollow element 136. The first longitudinal segment 160 is preferably formed with a low friction material, such as UHMW polyethylene or Nylatron®, so that the first longitudinal segment 160 may slide freely within the longitudinal hollow element 136. Both the longitudinal hollow element 136 and the first longitudinal segment 160 include a vertical guiding groove 176 (partially hidden by the barrier segment assemble 140) formed therewithin that is adapted to slidably receive the barrier segment assembly 140.

The longitudinal hollow element 136 of the second side rail 132 is shown partially broken away to reveal a second longitudinal segment 186 fixedly received within the lower portion of the longitudinal hollow element 136. An extension spring 184 extends between the first and second longitudinal segments 160 and 186 to urge the first longitudinal segment 160 downwardly within the longitudinal hollow element 136. An end cap 161 received on the upper end of the first longitudinal segment 160 abuts the end of the longitudinal hollow element 136 and prevents the first longitudinal segment 160 from being fully received within the longitudinal hollow element 136.

The wheelchair assembly 112 includes a control system for controlling the movement of the barrier segment assembly 140 within guiding groove 174 of the frame 128. A plurality of electrical or mechanical sensors are coupled to the frame 128 for indicating the barrier segment assembly 140 position. The sensors also signal the control system of the wheelchair lift assembly 112 to instruct the motor 196 to turn on, off, or reverse directions when actuated by the barrier segment assembly 140. Preferably, first and second mechanical limit switches 146 and 148 are mounted to the third cross member 138*c*. Although any general purpose limit switches or proximity sensors may be used, adjustable roller lever limit switches are preferred.

The first limit switch 146 includes a lever arm pivotally mounted to a switching mechanism (not shown) within the limit switch 146. The lever arm of the first limit switch 146 is directed downwardly from the third cross-member 138*c* such that the barrier segment assembly 140 engages the lever arm when it is slidably received within the horizontal guiding groove 178. As described above with respect to the first embodiment, when the barrier segment assembly 140 is slidably moved from the horizontal guiding groove 178 to the vertical guiding groove 176 (i.e. from the stowed position to the deployed position), the barrier segment assembly 140 disengages the lever arm of the first limit switch 146, thereby actuating the switch and sending a signal to the control system to turn the motor 196 off.

The lever arm of the second limit switch 148 is directed upwardly from the third cross-member 138*c* such that the barrier segment assembly 140 engages the lever arm when it is slidably received within the upper horizontal guiding groove 179. When the barrier segment assembly 140 is substantially received within the horizontal guiding groove 179 (i.e. in the stowed position), the barrier segment assembly 140 engages the lever arm of the second limit switch 148, thereby actuating the switch and sending a signal to the control system to turn the motor 196 off.

To translate the barrier assembly 10 into the deployed position, the drive assembly 194, which is substantially similar in construction and operation to the drive assembly 94, is activated to slidably move the barrier segment assembly 140 upwardly within the vertical guiding groove 176, as described above. When the barrier segment assembly 140 engages the upper end of the vertical guiding groove 176, the barrier segment assembly 140 urges the longitudinal segment 160 upwardly, extending from the longitudinal hollow element 136 so that the barrier segment assembly 140 and the first longitudinal segment 160 move upwardly together. The drive assembly 194 continues to drive the barrier segment assembly 140 upwardly until the first limit switch 146 is actuated and the motor 196 turns off.

To move the barrier assembly 110 into the stowed position, the drive assembly 194 is activated to slidably move the barrier segment assembly 140 downwardly within the vertical guiding grooves 176. The first longitudinal segments 160 are urged downwardly by the extension spring 184 when the barrier segment assembly 140 is lowered such that the barrier segment assembly 140 and the first longitudinal segment 160 move downwardly together. The drive assembly 194 continues to drive the barrier segment assembly 140 downwardly into the horizontal guiding grooves 178 and 179 until the barrier segment assembly 140 is substantially received within the horizontal guiding grooves 178 and 179 and the second limit switch 148 is actuated to turn off the motor 196.

While illustrative embodiments have been illustrated and described, it will be appreciated that various changes can be made therein without departing from the spirit and scope of the invention as claimed.

The embodiments of the invention in which an exclusive property or privilege is claimed are defined as follows:

1. A lift assembly, comprising:
(a) a lift frame;
(b) a lift platform reciprocally coupled to the lift frame and moveable between a raised position, wherein the lift platform is substantially coplanar with a first support surface, and a lowered position, wherein the lift platform is substantially coplanar with a second support surface;
(c) first and second vertical support structures extending upwardly from the first support surface to define an opening providing access to the first support surface; and
(d) a barrier assembly, comprising:
(i) a frame having a first side rail and a second side rail, the first and second side rails each having a horizontal portion and a vertical portion, the horizontal portions disposed beneath the first support surface and the vertical portions extending upwardly from the first support surface and coupled to the first and second vertical support structures;
(ii) a flexible barrier slidably disposed between the first and second side rails, the flexible barrier moveable between at least a stowed position and a deployed position, wherein at least a portion of the flexible barrier is disposed between the horizontal portions of the first and second side rails when the barrier is in the stowed position, and wherein the flexible barrier is substantially disposed between the vertical portions of the first and second side rails when the flexible barrier is in the deployed position; and
(iii) a drive assembly operably coupled to the barrier for selectively moving the barrier between at least the stowed position and the deployed position.

2. The lift assembly of claim 1, wherein the first and second side rails each include a vertical portion that is selectively extendable.

3. The lift assembly of claim 1, wherein the barrier comprises a plurality of longitudinal barrier segments hingedly coupled to one another.

4. The lift assembly of claim 3, wherein the longitudinal barrier segments include a first end and a second end, and wherein first and second pins are coupled to the first and second ends of each barrier segment, the first and second pins slidably received within the first and second side rails.

5. The lift assembly of claim 1, further comprising at least one sensor for limiting the movement of the barrier within the first and second side rails.

6. The lift assembly of claim 1, further comprising at least one sensor for stopping deployment of the barrier when an object is detected by the at least one sensor.

7. Lift assembly of claim 1, further comprising at least one sensor for stopping deployment of the barrier when at least a portion of the barrier is obstructed.

8. A lift assembly, comprising
(a) a lift frame;
(b) a lift platform reciprocally coupled to the lift frame and moveable between a raised position, wherein the lift platform is substantially coplanar with a first support surface, and, a lowered position, wherein the lift platform is substantially coplanar with a second support surface;

(c) first and second vertical support structures extending upwardly from the first support surface to define an opening providing access to the first support surface; and (d) a barrier assembly, comprising:

(i) a frame having a first side rail and a second side rail, the first and second side rails each having a horizontal portion and a vertical portion, the horizontal portions disposed beneath the first support surface and the vertical portions extending upwardly from the first support surface, the vertical portions coupled to the first and second vertical support structures; and (ii) a flexible barrier slidably disposed between the first and second side rails, the barrier drivable between at least a stowed position and a deployed position, wherein the barrier is in the stowed position when the platform is at a predetermined position and is not being moved between the raised and lowered positions, and wherein the barrier is in the deployed position when the platform is at a predetermined position or is being moved between the raised and lowered positions, and wherein the barrier is substantially disposed between the horizontal portions of the first and second side rails when the barrier is in the stowed position, and wherein the barrier is substantially disposed between the vertical portions of the first and second side rails when the barrier is in the deployed position.

9. The lift assembly of claim 8, wherein the first and second side rails each include a vertical portion that is selectively extendable.

10. The lift assembly of claim 8, wherein the barrier comprises a plurality of longitudinal barrier segments hingedly coupled to one another.

11. The lift assembly of claim 10, wherein the longitudinal barrier segments include a first end and a second end, and wherein first and second pins are coupled to the first and second ends of each barrier segment, the first and second pins slidably received within the first and second side rails.

12. The lift assembly of claim 8, further comprising at least one sensor for limiting the movement of the barrier within the first and second side rails.

13. The lift assembly of claim 8, further comprising at least one sensor for stopping deployment of the barrier when an object is detected by the at least one sensor.

14. The lift assembly of claim 8, further comprising at least one sensor for stopping deployment of the barrier when at least a portion of the barrier is obstructed.

* * * * *

UNITED STATES PATENT AND TRADEMARK OFFICE

CERTIFICATE OF CORRECTION

PATENT NO. : 7,766,127 B2
APPLICATION NO. : 11/470529
DATED : August 3, 2010
INVENTOR(S) : D. Morris et al.

It is certified that error appears in the above-identified patent and that said Letters Patent is hereby corrected as shown below:

| COLUMN | LINE | ERROR |
|---|---|---|
| 8 (Claim 7, line 1) | 57 | "Lift assembly" should read --The lift assembly-- |
| 8 (Claim 8, line 1) | 60 | After "A lift assembly, comprising" insert --:-- |
| 8 (Claim 8, line 6) | 65 | "surface, and, a lowered position," should read --surface, and a lowered position-- |

Signed and Sealed this

Sixteenth Day of November, 2010

David J. Kappos

David J. Kappos
*Director of the United States Patent and Trademark Office*